United States Patent [19]

Tavernier et al.

[11] 4,117,599

[45] Oct. 3, 1978

[54] APPARATUS FOR DRAFTING INACCURATE CONIC PERSPECTIVE

[75] Inventors: Jean Tavernier; Eugene Henaut, both of Paris, France

[73] Assignee: Societe de Recherches et de Promotion d'Activities Nouvelles Acno, Paris, France

[21] Appl. No.: 765,016

[22] Filed: Feb. 2, 1977

[30] Foreign Application Priority Data

Feb. 6, 1976 [FR] France ..... 76 03349

[51] Int. Cl.[2] ..... B43L 13/14

[52] U.S. Cl. ..... 33/77

[58] Field of Search ..... 33/77

[56] References Cited

U.S. PATENT DOCUMENTS 695,747 3/1902 Lydick ..... 33/79 R 3,226,831 1/1966 Tauernier ..... 33/77

*Primary Examiner*—Harry N. Haroian

*Attorney, Agent, or Firm*—Michael P. Breston

[57] ABSTRACT

The apparatus for drafting in accurate conic perspective essentially provides for the top edge of a drawing board a movable cursor integral by means of an arm with a pivot and carrying at the other end a scale G3. Another scale G1 is slidably mounted on a guide member pivoting about a pivot. The apparatus further comprises another scale G2 whose zero maker coincides with the pivot. The apparatus serves the purpose of determining automatically on scale G3, by means of readings and bearings taken on the various scales, the position of the point representing in perspective a point of the dimensioned plan view situated in the lefthand portion of the apparatus.

1 Claim, 3 Drawing Figures

Fig. 3
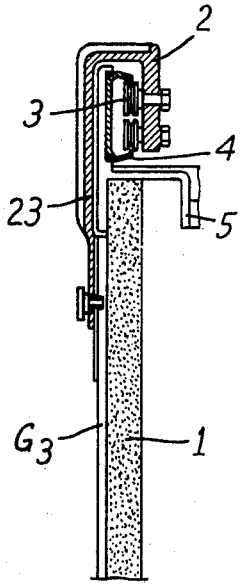
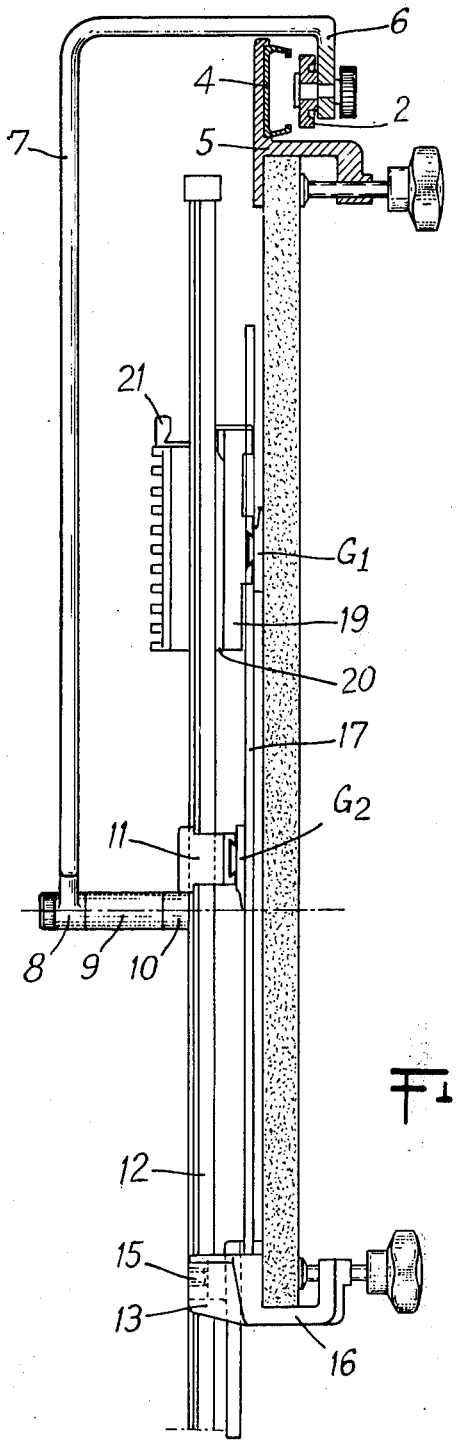
Fig. 2

APPARATUS FOR DRAFTING INACCURATE CONIC PERSPECTIVE

BACKGROUND OF THE INVENTION

The present invention relates, in general, to the accurate making of drawings of any object in conic perspective, starting either from a single view in projection revealing the three coordinates of all points, or from one plan view and another view from which the third coordinates of the various points may readily be read off.

Views in accurate perspective are desired by those who lack the possibility of imagining an object in a three-dimensional space, exactly as if they could see it in reality, although they only have at their disposal various two-dimensional views of the object.

For example, an architect has to deal with a client who wishes to have an idea of the final aspect of a building project; a modeler wishes to see in advance the part which he is supposed to model; a manufacturer wishes the views of the products available to his clients to be included in his catalogues, while his clients want to make sure, when ordering a spare part, that they use the correct reference number; an electrician or plumber wishes to have at hand a representation in perspective of the circuits according to which he has to fit pipes or electric wires; a warehouseman wishes to have at his disposal a stock card-index comprising drawings in accurate perspective of his goods, etc.

These examples demonstrate that the need for views in perspective is so general that there has always been a marked preference for this kind of representation.

The manual graphical tracing of such three dimensional drawings must be effected by experienced draftsmen, and hence such drawings are time consuming and expensive.

There exist numerous devices which can assist the draftsman in tracing drawings in perspective expeditiously, easily, and at low cost.

However, the known devices have in common the following drawbacks: complexity of the mechanical devices set into practice, e.g., bearings, pulleys, counter-cables, articulations, levers, etc., all of which soon become imperfect, bearing in mind the high degree of precision which such devices must have and maintain.

One of the co-inventors of the present invention has described a tool in this field which forms the object of French Pat. No. 1,351,371 issued Feb. 13, 1962, and of the following corresponding foreign Patents:

W. German : No. 1,461,5754
Great Britain : No. 1,037,684
Belgium : No. 636,275
U.S.A. : No. 3,226,831
Netherlands : No. 140,187
Italy : No. 711,845
Japan : No. 551,361
Switzerland : No. 400,581

Yet this patented apparatus still showed a certain number of drawbacks, even in its most advanced form, which was widely sold and which corresponds to a considerable extent to FIG. 3 of the above-cited British and U.S. patents.

In fact, the various elements of said apparatus necessarily had to be flat and superimposed one upon the other as close as possible to the plane of the drawing board over which they were moved in order to obtain a precision drawing. They also had to be made of transparent material to enable the draftsman to observe through them the dimensioned plan view on which the view in perspective was based. Yet, experience has shown that the use of such transparent elements was inadequate. Apart from being expensive, even materials of the best quality get scratched, dull and opaque after prolonged use and, above all, they often break at the various pivots and fastening means provided for them on the apparatus.

Moreover it has been necessary to pierce the drawing-board onto which the apparatus was secured.

The present invention eliminates the aforementioned drawbacks and achieves the following objects: structural simplicity which allows ease of manufacture at relatively low costs, higher ruggedness, increased precision, ease of handling, maximum visibility for the user, and a reduction to a minimum of the number of parts required to be made of transparent material, thereby considerably decreasing the risk of breaking of said parts.

SUMMARY OF THE INVENTION

The apparatus for drafting in accurate conic perspective according to the present invention, relates to the type which comprises a cursor movable along the upper edge of a drawing-board; means are carried by said cursor for supporting a first pivot movable in parallel to the direction of movement of said cursor in one of the two halves of the board; a second pivot is secured to the lower part of said half of the board; means are provided for establishing a first straight datum line passing through said pivots; a first graduated transparent scale is perpendicular to said first datum line and movable therealong; a second graduated transparent scale is perpendicular to said first datum line and passes through said first pivot; a ruler is provided with an engraved straight datum line pivotally mounted about said second pivot; and a third graduated scale, carried by said movable cursor, is arranged perpendicularly to the direction of movement of the latter and is provided in the other one of the said halves of the board. In accordance with the present invention, (a) the means borne by the movable cursor for carrying said first pivot are constituted by an arm with is substantially raised above the plane of the board, and is offset towards the left with respect to the datum line passing through the two pivots. The lower part of said arm is mounted on said first pivot;

(b) a support member carries the first pivot and is coupled to a guide member, the lower end of which slides freely in a first slide member mounted pivotally about said second pivot, the axis of said guide member being parallel to said first datum line passing through said two pivots and being offset to the left with respect to said line;

(c) the means for establishing said first datum line comprise said ruler which is pivotally mounted about said second pivot above said first scale.

(d) said first graduated transparent scale is mounted on a second slide member sliding along said guide member; and (e) said second graduated transparent scale, whose zero mark coincides with the axis of said first pivot and which is mounted on said support, is situated above said ruler carrying the engraved datum line.

BRIEF DESCRIPTION OF THE DRAWINGS

FIG. 2 is a side view of said apparatus, and

FIG. 3 is a sectional view taken along line III—III on FIG. 1.

DETAILED DESCRIPTION OF THE PREFERRED EMBODIMENT

Figure 1:
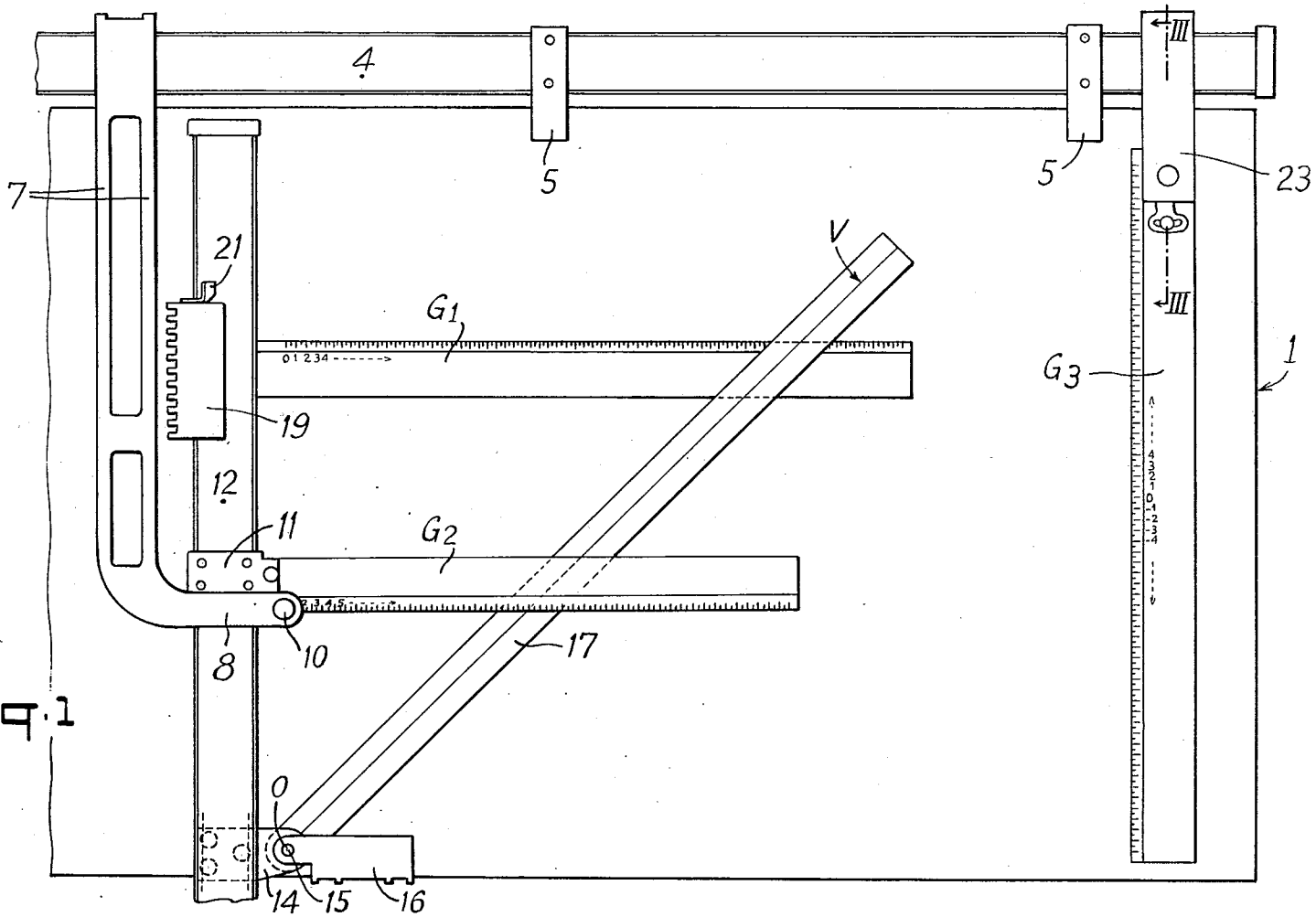
FIG. 1 is a front view of the drafting apparatus of this invention.

As regards the theoretical principles of descriptive geometry on which the apparatus according to the invention is based, the necessary details are contained in any of the prior patents cited hereinbefore.

The apparatus according to the invention, intended to be mounted on a drawing-board 1, comprises at the upper part of said board a cursor 2 which is movably mounted by means of rollers 3 (shown in FIG. 3) on a sectional rail 4, fixed to the upper edge of board 1 by means of clips 5. Rail 4 is provided with abutments intended to limit the lateral movement of 2. The left end of the movable cursor 2 is integral with one end 6 of an arm 7, whose portion which is parallel to the plane of board 1 is substantially raised with respect to said plane (FIG. 2), and is distinctly offset to the left with respect to the lower end 8 of arm 7.

The lower portion of arm 7 is thus cranked to the right and bears at its end a connecting shaft 9 provided with a threaded aperture receiving a first pivot 10 which is thus situated close to the plane of board 1.

Pivot 10 as such, consisting of a threaded pin, is borne by support 11 which is integral with a sectional guide member 12 whose lower end slides freely on rollers in a first sliding member 13 integral with a lateral clamp 14 provided with a bore for receiving the second pivot 15. The axis of the guide member 12 is parallel to the datum line passing through the axes of the two pivots 10 and 15 and is offset to the left with respect to said line.

Pivot 15 is carried by a fastening clamp 16 which is secured to the lower edge of the board.

A ruler 17 carrying an engraved datum line OV is equally pivotally mounted about pivot 15.

When ruler 17 abuts support 11, the line OV coincides with the line passing through the axes of the two pivots 10 and 15.

Moreover, the first graduated transparent scale G1 is mounted on a second sleeve 19 sliding along guide member 12 on rollers in a fashion analogous to the movable cursor 2, shown in FIG. 3.

A slot 20 is provided in sleeve 19, thus enabling the free sliding motion of the latter along guide member 12, even when sleeve 19 is situated at that part of the guide member where support 11 is secured. A blocking device 21 facilitates blocking of the sleeve 19 on sectional member 12. The graduated scale G1 rests on the surface of the drawing board. Ruler 17 in turn rests on ruler G1 and extends underneath support 11, as best seen in FIG. 2.

One end of the second graduated transparent scale G2 is secured to support 11, the zero mark of said graduation being situated precisely on the axis of pivot 10. Scale G2 in turn is above ruler 17 as well as above scale G1. Thus sleeve 19 is freely movable without any risk of collision between the graduated scales G1 and G2, arranged in parallel and being perpendicular to guide member 12.

Lastly, the right end of movable cursor 2 is provided with a support 23 to which the third graduated scale G3 is secured. Scale G3 comprises a central zero point 0 wherefrom extend positive and negative graduations, upwardly and downwardly respectively.

It is clear that the apparatus described hereinbefore comprises effectively all the features necessary in order to facilitate its design: in fact, most of the mechanical parts to be used are very simple and are readily available as standardized products.

According to the above described arrangement, the mobility of the movable parts is assured with a minimum of play or friction.

Ruler 17 and scales G1 and G2 are the only parts of the apparatus which must necessarily be transparent. As far as visibility is concerned, the clearance between arm 7 and the substantial drawing board allows clear vision of any part of the dimensioned plan view which is to be shown in perspective, regardless of the position of the movable cursor 2.

Moreover, scales G1 and G2 can be standardized rulers which are then fixed to their respective supports 11 and 23. Manufacturing costs of the apparatus are thereby reduced especially since ruler 17 fulfills two functions.

Without going into the details of the directions for use of such an apparatus, it will just be explained how to achieve by means of said apparatus the perspective view of a point whose three coordinates are known.

A dimensional plan view being placed on the left-hand portion of the drawing-board, one proceeds step by step as follows:

(1) by shifting the movable cursor 2 and consequently all of the members secured thereto (arm 7, guide member 12 pivotally mounted about pivot 15, andd graduated scale G3) while ruler 17 abuts support member 11, the engraved line OV is made to pass through the point in question;

(2) by sliding sleeve 19 on sectional member 12, point O of graduated scale G1 is made to coincide with the point in question;

(3) ruler 17 provided with the datum line OV is made to pivot and thus fulfills its second function, i.e. said line OV passes through that value of the graduation of scale G1 which is identical to the third coordinate of the point in question;

(4) it is then sufficient to read off on scale G2 the value of the graduation of G2 through which passes line OV; and (5) the same vlaue read off on scale G2 is then marked on the graduation of the third scale G3 either positively or negatively, depending on whether the third coordinate of the point in question is positive or negative, and the position in conic perspective of the desired point then appears in the right-hand portion of the drawing board.

What is claimed is:

1. An apparatus for drafting in conic perspective over a drawing board, said apparatus comprising:

a cursor, a guide rail supporting said cursor for movement along the upper edge of said board;

a slide bracket slidably mounted along the lower edge of said board and carrying a first pivot;

a guide bracket pivotably mounted on said first pivot;

a guide member slidably mounted in said guide bracket, a support bracket secured to said guide member and carrying a second pivot, and a slide member having a slot therealong for slidably receiving therein said guide member, said slide member being slidable along said guide member over said support bracket;

an arm having an upper end coupled to for movement with said cursor, an intermediate portion parallel to and spaced from the plane of said board, and a lower end laterally offset from said intermediate portion, said lower end being pivotably mounted on said second pivot, whereby the axis of said intermediate portion is parallel to a line passing through said first and second pivots;

a transparent ruler carrying a datum line, said ruler being pivotably mounted about said first pivot, said datum line passing through the axes of said first and second pivots when said ruler is in its rest position;

a first transparent graduated scale mounted on said slide member, said first scale being parallel to the plane of said board and lying under said ruler, a second transparent graduated scale mounted on said support bracket above said ruler, the zero graduations of said first and second scales lying on a line passing through the axes of said first and second pivots;

and a third graduated scale coupled to for movement with said cursor, the axis of said third scale being substantially perpendicular to the direction of movement of said cursor, and being laterally spaced from said guide member.

* * * * *

UNITED STATES PATENT OFFICE

CERTIFICATE OF CORRECTION

Patent No. 4,117,599 Dated October 3, 1978

Inventor(s) Jean Tavernier et al.

It is certified that error appears in the above-identified patent and that said Letters Patent are hereby corrected as shown below:

| | |
|---|---|
| Claim 1, line 6, | "a slide bracket slidably mounted along the lower edge" should read -- a fixed bracket mounted on a point of the lower edge --. |
| line 15, | after "bracket" should be inserted -- whereby the axis of said guide member is parallel to a line passing through the axes of said first and second pivots; --. |
| lines 17-18, | "parallel to and" should be deleted. |
| lines 21-23, | ", whereby the axis of said intermediate portion is parallel to a line passing through said first and second pivots" should be deleted. |
| line 34, | "a" should read -- said --. |

UNITED STATES PATENT OFFICE

CERTIFICATE OF CORRECTION

Patent No. 4,117,599 Dated October 3, 1978

Inventor(s) Jean Tavernier et al.

It is certified that error appears in the above-identified patent and that said Letters Patent are hereby corrected as shown below:

line 35, after "pivots" should be added -- , and said first and second transparent graduated scales being perpendicular to said line passing through the axes of said first and second pivots --.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*